US005851233A

United States Patent [19]

Pedersen et al.

[11] Patent Number: 5,851,233

[45] Date of Patent: Dec. 22, 1998

[54] BLEACHING PROCESS COMPRISING USE OF A PHENOL OXIDIZING ENZYME, A HYDROGEN PEROXIDE SOURCE AND AN ENHANCING AGENT

[75] Inventors: Anders Hjelholt Pedersen, Lyngby; Jesper Vallentin Kierulff, Valby, both of Denmark

[73] Assignee: Novo Nordisk A/S, Bagsvaerd, Denmark

[21] Appl. No.: 849,048

[22] PCT Filed: Oct. 18, 1995

[86] PCT No.: PCT/DK95/00418

§ 371 Date: Apr. 25, 1997

§ 102(e) Date: Apr. 25, 1997

[87] PCT Pub. No.: WO96/12846

PCT Pub. Date: May 2, 1996

[30] Foreign Application Priority Data

Oct. 20, 1994 [DK] Denmark ..... 1216/94
Jul. 7, 1995 [DK] Denmark ..... 803/95

[51] Int. Cl.[6] ..... C11D 3/386; D06P 3/02

[52] U.S. Cl. ..... 8/102; 8/107; 8/111; 510/305; 510/312; 510/313; 435/263

[58] Field of Search ..... 8/102, 111, 107; 510/312, 313, 305; 435/263

[56] References Cited

FOREIGN PATENT DOCUMENTS

| | | |
|---|---|---|
| WO 91/05839 | 5/1991 | WIPO . |
| WO 92/18683 | 10/1992 | WIPO . |
| WO 94/12619 | 6/1994 | WIPO . |
| WO 94/12621 | 6/1994 | WIPO . |
| WO 96/12845 | 5/1996 | WIPO . |

*Primary Examiner*—Alan Diamond
*Attorney, Agent, or Firm*—Steve T. Zelson, Esq.; Cheryl H. Agris, Esq.

[57] ABSTRACT

The invention relates to a process for providing a bleached look in the color density of the surface of dyed fabric, especialy cellulosic fabric such as denim, comprising use of a phenol oxidizing enzyme such as a peroxidase or a laccase, a hydrogen peroxide source and a phenothiazine or phenoxazine enhancing agent represented by formula (I).

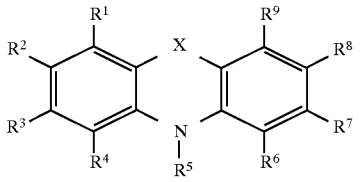

22 Claims, No Drawings

BLEACHING PROCESS COMPRISING USE OF A PHENOL OXIDIZING ENZYME, A HYDROGEN PEROXIDE SOURCE AND AN ENHANCING AGENT

CROSS-REFERENCE TO RELATED APPLICATIONS

This application is a 35 U.S.C. 371 national application of PCT/DK95/00418 filed Oct. 18, 1995 and claims priority under 35 U.S.C. 119 of Danish application 1216/94 filed Oct. 20, 1994 and 803/95 filed Jul. 7, 1995, the contents of which are fully incorporated herein by reference.

FIELD OF INVENTION

The present invention relates to a process for providing a bleached look in the colour density of the surface of dyed fabric, especially cellulosic fabric such as denim.

BACKGROUND ART

The most usual method of providing a bleached stone-washed look in denim fabric or jeans is by washing the denim or jeans made from such fabric in the presence of pumice stones to provide the desired localized lightening of the colour of the fabric. This is then followed by a bleaching process where the fabric is treated with sodium hypochlorite at 60° C. and pH 11–12 for up to 20 min., followed by a neutralisation step and a rinsing. Use of hypochlorite is undesirable, both because chlorite itself is undesirable and because the neutralisation subsequently generates high amounts of salts leading to disposal and pollution problems.

Bleaching enzymes such as peroxidases together with hydrogen peroxide or oxidases together with oxygen have also been suggested for bleaching of dyed textiles (see WO 92/18683), either alone or together with a phenol such as p-hydroxycinnamic acid, 2,4-dichlorophenol, p-hydroxybenzene sulphonate, vanillin or p-hydroxybenzoic acid. The disclosed process is not efficient as can be seen from Example 1 of the present invention.

Thus there is still a need for providing a bleached look in dyed fabrics. The problem to be solved is not easy as many VAT-dyes, especially indigo, are not soluble in water and have a very compact structure on the fibre surface, making them difficult for an enzyme to attack.

SUMMARY OF THE INVENTION

Surprisingly it has been found that it is possible to create a very efficient process for providing a bleached look in the colour density of the surface of dyed fabric, the process comprising contacting, in an aqueous medium, a dyed fabric with a phenol oxidizing enzyme system and an enhancing agent of the following formula:

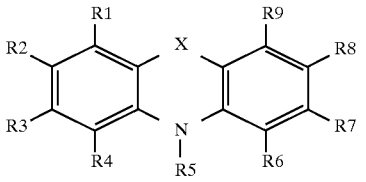

in which formula X represents (—O—) or (—S—), and the substituent groups $R^1$–$R^9$, which may be identical or different, independently represents any of the following radicals: hydrogen, halogen, hydroxy, formyl, carboxy, and esters and salts hereof, carbamoyl, sulfo, and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{10}$; and which phenyl may furthermore be unsubstituted or substituted with one or more substituent groups $R^{10}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{10}$;

which substituent group $R^{10}$ represents any of the following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidin-1-yl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^9$ may together form a group —B—, in which B represents any of the following the groups: $(—CHR^{10}—N=N—)$, $(—CH=CH—)_n$, $(—CH=N—)_n$ or $(—N=CR^{10}—NR^{11}—)$, in which groups n represents an integer of from 1 to 3, $R^{10}$ is a substituent group as defined above and $R^{11}$ is defined as $R^{10}$.

DETAILED DESCRIPTION OF THE INVENTION

Dyed Fabric

The process of the invention is most beneficially applied to cellulose-containing fabrics, such as cotton, viscose, rayon, ramie, linen, Tencel, or mixtures thereof, or mixtures of any of these fibres, or mixtures of any of these fibres together with synthetic fibres such as mixtures of cotton and spandex (stretch-denim). In particular, the fabric is denim. The process of the invention may also be applied to other natural materials such as silk.

The fabric may be dyed with vat dyes such as indigo, or indigo-related dyes such as thioindigo.

In a most preferred embodiment of the process of the invention, the fabric is indigo-dyed denim, including clothing items manufactured therefrom.

Phenol Oxidizing Enzyme Systems

By the term "a phenol oxidizing enzyme system" is meant a system in which an enzyme, by using hydrogen peroxide or molecular oxygen, is capable of oxidizing organic compounds containing phenolic groups. Examples of such enzymes are peroxidases and oxidases.

If the phenol oxidizing enzyme system requires a source of hydrogen peroxide, the source may be hydrogen peroxide or a hydrogen peroxide precursor for in situ production of hydrogen peroxide, e.g. percarbonate or perborate, or a hydrogen peroxide generating enzyme system, e.g. an oxidase and a substrate for the oxidase, or an amino acid oxidase and a suitable amino acid, or a peroxycarboxylic acid or a salt thereof. Hydrogen peroxide may be added at the beginning of or during the process, e.g. in a concentration corresponding to 0.001–25 mM $H_2O_2$.

If the phenol oxidizing enzyme system requires molecular oxygen, molecular oxygen from the atmosphere will usually be present in sufficient quantity.

The enzyme of the phenol oxidizing enzyme systems may be an enzyme exhibiting peroxidase activity or a laccase or a laccase related enzyme as described below.

According to the invention the concentration of the phenol oxidizing enzyme in the aqueous medium where the localized variation in the colour density of the surface of the dyed fabric is taking place, may be 0.001–10000 μg of enzyme protein per g denim, preferably 0.1–1000 μg of enzyme protein per g denim, more preferably 1–100 μg of enzyme protein per g denim.

Peroxidases and Compounds possessing Peroxidase Activity

Compounds possessing peroxidase activity may be any peroxidase enzyme comprised by the enzyme classification (EC 1.11.1.7), or any fragment derived therefrom, exhibiting peroxidase activity, or synthetic or semisynthetic derivatives thereof (e.g. porphyrin ring systems or microperoxidases, cf. e.g. U.S. Pat. No. 4,077,768, EP 537,381, WO 91/05858 and WO 92/16634).

Preferably, the peroxidase employed in the method of the invention is producible by plants (e.g. horseradish or soybean peroxidase) or microorganisms such as fungi or bacteria. Some preferred fungi include strains belonging to the subdivision Deuteromycotina, class Hyphomycetes, e.g. Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the subdivision Basidiomycotina, class Basidiomycetes, e.g. Coprinus, Phanerochaete, Coriolus or Trametes, in particular *Coprinus cinereus* f. microsporus (IFO 8371), *Coprinus macrorhizus, Phanerochaete chrysosporium* (e.g. NA-12) or Trametes (previously called Polyporus), e.g. *T. versicolor* (e.g. PR4 28-A).

Further preferred fungi include strains belonging to the subdivision Zygomycotina, class Mycoraceae, e.g. Rhizopus or Mucor, in particular *Mucor hiemalis.*

Some preferred bacteria include strains of the order Actinomycetales, e.g. *Streptomyces spheroides* (ATTC 23965), *Streptomyces thermoviolaceus* (IFO 12382) or *Streptoverticillum verticillium* ssp. *verticillium.*

Other preferred bacteria include *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g. *M. virescens.*

The peroxidase may furthermore be one which is producible by a method comprising cultivating a host cell transformed with a recombinant DNA vector which carries a DNA sequence encoding said peroxidase as well as DNA sequences encoding functions permitting the expression of the DNA sequence encoding the peroxidase, in a culture medium under conditions permitting the expression of the peroxidase and recovering the peroxidase from the culture.

Particularly, a recombinantly produced peroxidase is a peroxidase derived from a Coprinus sp., in particular *C. macrorhizus* or *C. cinereus* according to WO 92/16634, or a variant thereof, e.g., a variant as described in WO 94/12621.

In the context of this invention, peroxidase acting compounds comprise peroxidase active fragments derived from cytochromes, haemoglobin or peroxidase enzymes, and synthetic or semisynthetic derivatives thereof, e.g. iron porphins, iron porphyrins, and iron phthalocyanine and derivatives thereof.

Determination of peroxidase activity: 1 peroxidase unit (PODU) is the amount of enzyme that catalyzes the conversion of 1 μmol hydrogen peroxide per minute at the following analytical conditions: 0.88 mM hydrogen peroxide, 1.67 mM 2,2'-azinobis(3-ethylbenzothiazoline-6-sulfonate), 0.1M phosphate buffer, pH 7.0, incubated at 30° C., photometrically followed at 418 nm.

Laccase and Laccase Related Enzymes

In the context of this invention, laccases and laccase related enzymes contemplate any laccase enzyme comprised by the enzyme classification (EC 1.10.3.2), any chatechol oxidase enzyme comprised by the enzyme classification (EC 1.10.3.1), any bilirubin oxidase enzyme comprised by the enzyme classification (EC 1.3.3.5) or any monophenol monooxygenase enzyme comprised by the enzyme classification (EC 1.14.99.1).

The laccase enzymes are known from microbial and plant origin. The microbial laccase enzyme may be derived from bacteria or fungi (including filamentous fungi and yeasts) and suitable examples include a laccase derivable from a strain of Aspergillus, Neurospora, e.g., *N. crassa,* Podospora, Botrytis, Collybia, Fomes, Lentinus, Pleurotus, Trametes, (previously called Polyporus), e.g., *T. villosa* and *T. versicolor,* Rhizoctonia, e.g., *R. solani,* Coprinus, e.g., *C. plicatilis* and *C. cinereus,* Psatyrella, Myceliophthora, e.g., *M. thermophila,* Schytalidium, Phlebia, e.g., *P. radita* (WO 92/01046), or Coriolus, e.g., *C.hirsutus* (JP 2-238885).

The laccase or the laccase related enzyme may furthermore be one which is producible by a method comprising cultivating a host cell transformed with a recombinant DNA vector which carries a DNA sequence encoding said laccase as well as DNA sequences encoding functions permitting the expression of the DNA sequence encoding the laccase, in a culture medium under conditions permitting the expression of the laccase enzyme, and recovering the laccase from the culture.

Determination of Laccase Activity (LACU)

Laccase activity is determined from the oxidation of syringaldazin under aerobic conditions. The violet colour produced is photometered at 530 nm. The analytical conditions are 19 μM syringaldazin, 23.2 mM acetate buffer, pH 5.5, 30° C., 1 min. reaction time.

1 laccase unit (LACU) is the amount of enzyme that catalyses the conversion of 1.0 μmole syringaldazin per minute at these conditions.

Enhancing Agents

The enhancing agent used in the present invention may be described by the following formula:

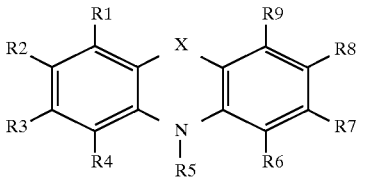

in which formula X represents (—O—) or (—S—), and the substituent groups $R^1$–$R^9$, which may be identical or different, independently represents any of the following radicals: hydrogen, halogen, hydroxy, formyl, carboxy, and esters and salts hereof, carbamoyl, sulfo, and esters and salts hereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; which carbamoyl, sulfamoyl, and amino groups may furthermore be unsubstituted or substituted once or twice with a substituent group $R^{10}$; and which phenyl may furthermore be unsubstituted or substituted with one or more substituent groups $R^{10}$; and which $C_1$–$C_{14}$-alkyl, $C_1$–$C_5$-alkoxy, carbonyl-$C_1$–$C_5$-alkyl, and aryl-$C_1$–$C_5$-alkyl groups may be saturated or unsaturated, branched or unbranched, and may furthermore be unsubstituted or substituted with one or more substituent groups $R^{10}$;

which substituent group $R^{10}$ represents any of the following radicals: halogen, hydroxy, formyl, carboxy and esters and salts hereof, carbamoyl, sulfo and esters and salts hereof, sulfamoyl, nitro, amino, phenyl, aminoalkyl, piperidino, piperazinyl, pyrrolidin-1-yl, $C_1$–$C_5$-alkyl, $C_1$–$C_5$-alkoxy; which carbamoyl, sulfamoyl, and amino groups may furthermore be unsubstituted or substituted once or twice with hydroxy, $C_1$–$C_5$-alkyl, $C_1$–$C_5$-alkoxy; and which phenyl may furthermore be substituted with one or more of the following radicals: halogen, hydroxy, amino, formyl, carboxy and esters and salts hereof, carbamoyl, sulfo and esters and salts hereof, and sulfamoyl; and which $C_1$–$C_5$-alkyl, and $C_1$–$C_5$-alkoxy groups may furthermore be saturated or unsaturated, branched or unbranched, and may furthermore be substituted once or twice with any of the following radicals: halogen, hydroxy, amino, formyl, carboxy and esters and salts hereof, carbamoyl, sulfo and esters and salts hereof, and sulfamoyl;

or in which general formula two of the substituent groups $R^1$–$R^9$ may together form a group —B—, in which B represents any of the following the groups: $(—CHR^{10}—N=N—)$, $(—CH=CH—)_n$, $(—CH=N—)_n$ or $(—N=CR^{10}—NR^{11}—)$, in which groups n-represents an integer of from 1 to 3, $R^{10}$ is a substituent group as defined above and $R^{11}$ is defined as $R^{10}$. (It is to be understood that if the above mentioned formula comprises two or more $R^{10}$-substituent groups, these $R^{10}$-substituent groups may be the same or different).

In particular embodiments, the enhancing agent is 10-methylphenothiazine, phenothiazine-10-propionic acid, N-hydroxysuccinimide phenothiazine-10-propionate, 10-ethylphenothiazine-4-carboxylic acid, 10-ethylphenothiazine, 10-propylphenothiazine, 10-isopropylphenothiazine, methyl phenothiazine-10-propionate, 10-phenylphenothiazine, 10-allylphenothiazine, 10-(3-(4-methylpiperazin-1-yl)propyl)phenothiazine, 10-(2-pyrrolidin-1-yl-ethyl)phenothiazine, 2-methoxy-10-methylphenothiazine, 1-methoxy-10-methylphenothiazine, 3-methoxy-10-methylphenothiazine, 3,10-dimethylphenothiazine, 3,7,10-trimethylphenothiazine, 10-(2-hydroxyethyl)phenothiazine, 10-(3-hydroxypropyl) phenothiazine, 3-(2-hydroxyethyl)-10-methylphenothiazine, 3-hydroxymethyl-10-methylphenothiazine, 3,7-dibromophenothiazine-10-propionic acid, phenothiazine-10-propionamide, chlorpromazine, 2-chloro-10-methylphenothiazine, 2-acetyl-10-methylphenothiazine, 10-methylphenoxazine, 10-ethylphenoxazine, phenoxazine-10-propionic acid, 10-(2-hydroxyethyl)phenoxazine or 4-carboxyphenoxazine-10-propionic acid.

The enhancing agent of the invention may be present in concentrations of from 0.005 to 1000 μmole per g denim, preferably 0.05 to 500 μmole per g denim, more preferably 0.5 to 100 μmole per g denim.

Stability of the Radical of the Enhancing Agent

Without being limited to any theory it is presently contemplated that there is a positive correlation between the half-life of the radical which the enhancing agent forms in the relevant aqueous medium and its efficiency in providing a bleached look in the colour density of the surface of the dyed fabric together with the phenol-oxidizing enzyme system, and that this half-life is significantly longer than the half-life of any of the substances selected from the group consisting of p-hydroxycinnamic acid, 2,4-dichlorophenol, p-hydroxybenzene sulphonate, vanillin and p-hydroxybenzoic acid (i.e. the enhancing agents disclosed in WO 92/18683).

This invention therefore further relates to a process for providing a bleached look in the colour density of the surface of dyed fabric, the process comprising contacting, in an aqueous medium, a dyed fabric with a phenol oxidizing enzyme system and an enhancing agent, wherein said enhancing agent is capable of forming a radical having a half-life, in said aqueous medium, which is at least 10 times longer than the radical half-life of any one of the substances selected from the group consisting of p-hydroxycinnamic acid, 2,4-dichlorophenol, p-hydroxybenzene sulphonate, vanillin and p-hydroxybenzoic acid, tested in the same aqueous medium, in particular wherein said enhancing agent is capable of forming a radical having a half-life, in said aqueous medium, which is at least 100 times longer than the radical half-life of any one of the substances selected from the group consisting of p-hydroxycinnamic acid, 2,4-dichlorophenol, p-hydroxybenzene sulphonate, vanillin and p-hydroxybenzoic acid, tested in the same aqueous medium.

As the half-life of the radical is dependent on, inter alia, the pH, the temperature and the buffer of the aqueous medium, it is very important that all these factors are the same when the half-lifes of the radicals of various enhancing agents are compared.

Industrial Applications

The process of the present invention is typically used in industrial machines for making fabric look bleached. Normally, the process of the invention will be performed on fabric already stonewashed, but the process may also be applied to fabric which has not undergone a stonewashing process beforehand. Most commonly the fabric is added to the machine according to the machine capacity per the manufacturer's instructions. The fabric may be added to the machine prior to introducing water or the fabric may be added after water is introduced. The phenol oxidizing enzyme system and the enhancing agent of the invention may be present in the water prior to adding the fabric or they may be added after the fabric has been wetted. The phenol oxidizing enzyme system may be added simultaneously with the enhancing agent or they may be added separately. After the fabric has been contacted with the phenol oxidizing enzyme system and the enhancing agent of the invention it should be agitated in the machine for a sufficient period of time to ensure that the fabric is fully wetted and to ensure the action of the enzyme system and the enhancing agent.

We have found (see the Examples below) that the optimum bleaching conditions might be a compromise between optimum stability of the enzyme, optimum activity of the enzyme, optimum stability of the radical of the enhancing agent, and optimum reactivity (oxidation potential) of the radical, as well as choice of buffering system (buffer capacity, buffer toxicity, costs of buffer etc.).

The invention is further illustrated in the following examples which are not intended to be in any way limiting to the scope of the invention as claimed.

EXAMPLE 1

Bleaching Denim with Laccase and Different Enhancing Agents

The test procedure for denim bleaching was performed as described below:

Enhancing Agents:

The enhancing agents were obtained from Sigma-Aldrich, Janssen Chimica, Kodak, Tokyo Kasai Organic Chemicals, Daiichi Pure Chemicals Co. or Boehringer Mannheim; N-methylated derivatives of phenothiazine and phenoxazine may be prepared by methylation with methyliodide as described by Cornel Bodea and Ioan Silberg in "Recent Advances in the Chemistry of Phenothiazines" (Advances in heterocyclic chemistry, 1968, Vol. 9, pp. 321–460); B. Cardillo & G. Casnati in Tetrahedron, 1967, Vol. 23, p. 3771. Phenothiazine and phenoxazine propionic acids may be prepared as described in *J. Org. Chem.* 15, 1950, pp. 1125–1130. Hydroxyethyl and hydroxypropyl derivatives of phenothiazine and phenoxazine may be prepared as described by G. Cauquil in *Bulletin de la Society Chemique de France,* 1960, p.1049.

Enzyme:

Laccase derived from *Trametes villosa* (SP 504, available from Novo Nordisk A/S) was used.

Procedure:

18 ml 0.01M B&R (Britt & Robinson) buffer (pH 4, 6, or 8) were added to a 50 ml conical flask. A magnet bar (4 cm) and a circular piece of stone washed denim (3.5 cm diameter ~0.4 g) were added to the flask together with 1 ml of the stock solution of the enhancing agent to be tested and 1 ml of enzyme, giving a denim:liquor (w/w) ratio of 1:50; the final concentrations of the enhancing agent and the enzyme shown in Table 1–2 below.

The flask was incubated for 2–3 hours on a magnet stirrer in a water bath (50° C. and approximately 200 rpm). After the enzymatic bleaching, the denim swatch was rinsed with distilled water and air dried, whereafter it was evaluated for the degree of bleaching. The evaluation was performed visually and by using a Minolta Chroma Meter CR200 or a Minolta Chroma Meter CR300.

Evaluation:

A Minolta Chroma Meter CR200 or CR300 (available from Minolta Corp.) was used according to Manufacturer's instructions to evaluate the degree of bleaching as well as to estimate any discoloration using the change in the colour space coordinates L*a*b* (CIELAB-system): L* gives the change in white/black at a scale of from 0 to 100, a* gives the change in green (−a*)/red (+a*), and b* gives the change in blue (−b*)/yellow (+b*). A decrease in L* means an increase in black colour (decrease of white colour), an increase in L* means an increase in white colour (a decrease in black colour), a decrease in a* means an increase in green colour (decrease in red colour), an increase in a means an increase in red colour (a decrease in green colour), a decrease in b* means an increase in blue colour (a decrease in yellow colour), and an increase in b* means an increase in yellow colour (a decrease in blue colour).

The bleached stone washed denim swatches were compared to non-treated stone washed denim swatches.

The Minolta Chroma Meter CR200 or the Minolta Chroma Meter CR300 was operated in the L*a*b* colour space (coordinate system). The light source used was a CIE light standard C. Each measurement was an average of 3 measurements. The instrument was calibrated using a Minolta calibration plate (white). 10 non-treated denim swatches were measured 2 times each and the average of the coordinates L*a*b* were calculated and entered as a reference. The coordinates of the samples were then calculated as the difference (A) of the average of 3 measurements on each swatch from the reference value of the coordinates L*a*b*.

TABLE 1

Table 1 shows Δ(L*/a*/b*) between a swatch treated with the tested system and a non-treated swatch at pH 4, 6 and 8.

| Tested System | pH 4 | pH 6 | pH 8 |
|---|---|---|---|
| Phenoxazine-10-propionic acid | | | |
| (3 hours): (1000 μM ~ 50 μmole/g) (1.0 LACU/ml ~ 780 μg/g) | 25.8/2.6/33.7 | 32.6/2.6/33.1 | 6.4/−1.8/2.4 |
| (2 hours): (100 μM ~ 5 μmole/g) (0.1 LACU/ml - 78 μg/g) | | 5.5/−1.0/1.9 | |
| Phenoxazine-10-hydroxyethyl (3 hours): (1000 μM ~ 50 μmole/g) (1.0 LACU/ml ~ 780 μg/g) | 23.9/6.5/33.6 | 18.9/−0.1/-29.2 | 3.3/−0.8/1.6 |
| Phenothiazine-10-ethyl-4-carboxy (3 hours): (1000 μM ~ 50 μmole/g) (1.0 LACU/ml ~ 780 μg/g) | 11.9/−1.7/2.8 | 20.6/−2.9/5.8 | 2.0/−0.3/0.5 |

TABLE 1-continued

Table 1 shows Δ(L*/a*/b*) between a swatch treated with the tested system and a non-treated swatch at pH 4, 6 and 8.

| Tested System | pH 4 | pH 6 | pH 8 |
|---|---|---|---|
| Phenothiazine-10-propionic acid (3 hours): (1000 μM ~ 50 μmole/g) (1.0 LACU/ml ~ 780 μg/g) | 14.9/−2.3/3.7 | 11.6/−1.8/3.0 | 5.6/−1.1/0.8 |
| Promazine hydrochloride (3 hours): (1000 μM ~ 50 μmole/g) (0.1 LACU/ml ~ 78 μg/g) | 16.1/−1.8/4.6 | 8.1/−1.2/3.3 | −2.3/0.7/0.0 |
| Phenothiazine-10-ethylalcohol (3 hours): (1000 μM ~ 50 μmole/g) (1.0 LACU/ml ~ 780 μg/g) | 19.7/−2.4/4.9 | 15.7/−1.9/4.2 | 4.6/−0.6/0.5 |

Visually a ΔL* around 5 gives a significant effect so it can be seen from the results presented in Table 1 that all the tested systems have a significant effect at pH 4–6 in bleaching denim.

TABLE 2

Table 2 shows Δ(L*/a*/b*) between a swatch treated with the enhancing agents described in WO 92/18683 + laccase (0.1–1.0 LACU/ml corresponding to 78 μg enzyme protein/g denim − 780 μg enzyine protein/g denim) and a non-treated swatch at pH 4–6 and 8.

| Tested System | pH 4 | pH 6 | pH 8 |
|---|---|---|---|
| p-Hydroxy-benzoic acid: (1000 μM ~ 50 μmole/g) Laccase: (0.1 LACU/ml ~ 78 μg/g) | 0.85/ −0.09/ 0.61 | 0.91/ −0.19/ −0.14 | −0.21/ 0.24/ −0.17 |
| p-Hydroxy-benzene-sulfonate: (1000 μM ~ 50 μmole/g) Laccase: (0.1 LACU/ml ~ μg/g) | −0.18/ 0.14/ −0.12 | 0.33/ 0.06/ −0.22 | −0.51/ 0.17/ −0.20 |
| 2,4-Dichloro-phenol: (1000 μM ~ 50 μmole/g) Laccase: (0.1 LACU/ml ~ 78 μg/g) | 0.64/ −0.22/ 0.5 | −0.19/ −0.19/ 0.57 | −0.54/ 0.16/ −0.14 |
| Vanillin: (1000 μM ~ 50 μmole/g) Laccase: (1.0 LACU/ml ~ 780 μg/g) | −0.67/ −0.34/ 1.41 | 0.28/ −0.03/ 0.49 | −0.38/ −0.05/ 0.75 |

TABLE 2-continued

Table 2 shows Δ(L*/a*/b*) between a swatch treated with the enhancing agents described in WO 92/18683 + laccase (0.1–1.0 LACU/ml corresponding to 78 μg enzyme protein/g denim − 780 μg enzyine protein/g denim) and a non-treated swatch at pH 4–6 and 8.

| Tested System | pH 4 | pH 6 | pH 8 |
|---|---|---|---|
| p-Hydroxy-cinnamic acid: (1000 μM ~ 50 μmole/g) Laccase: (1.0 LACU/ml~ 780 μg/g) | 0.64/ −0.53/ 1.62 | 4.47/ −0.63/ 3.88 | 2.97/ −0.45/ 0.79 |

From the results presented in Table 2 it can be seen that none of the prior art described enhancing agents have any significant effect in bleaching the denim.

EXAMPLE 2

Bleaching Denim with Laccase and Phenothiazine-10-Propionic Acid using Different Buffers To illustrate the effect of different buffers on the denim bleaching performance the following tests have been made:

11 different buffers and 3 types of water were tested. Each buffer was prepared at a concentration of 0.01M, and pH adjusted to pH 6.5 with NaOH or with the corresponding acid. 80 ml of the buffer in question was added to a 200 ml glass beaker together with a magnet bar (4 cm), and 8 circular pieces of denim (3.5 cm in diameter ~0.4 g), giving a denim:liquor ratio of 1:25.

The glass beaker was incubated on a magnet stirrer (300 rpm) in a water bath at 60° C., and a pH electrode was dipped into the liquor in the middle of the beaker in order to monitor and control pH at pH 6.5 (i.e. the experiments were run under pH-stat conditions using a Radiometer pH-stat (PHM 82 or PHM 62 pH meter, TTT 80 Titrator, ABU 80 Autoburette) with automatic titration with the corresponding acid (0.1M) if and when pH increased above pH 6.5). Following equilibration at pH 6.5, phenothiazine-10-propionic acid (PPT), 0.02M in 96% ethanol, was added to a final concentration of 250 μM ~6.3 μmole/g together with laccase from *Trametes villosa* (TvL) (20 LACU/ml in water, available from Novo Nordisk A/S) to a final concentration of 0.1 LACU/ml ~39 μg/g. After 30 minutes the denim swatches were rinsed in tap-water and air dried on filter paper overnight, and the resulting degree of bleaching was determined as mentioned above in Example 1. The results are shown in Table 3.

TABLE 3

Bleaching obtained using 250 μM PPT ~ 6.3 μmole/g and 0.1 LACU/ml ~ 39 μg/g of TvL at pH 6.5(pH-stat) in 30 minutes at 60° C. in different buffer systems, all 0.01M (except the systems using various sources of water). pH was continuously monitored and controlled at pH 6.5 titrating with the corresponding acid, except that for borate buffer and glycine buffer pH was controlled titrating with 0.1M HCl, and for de-ionized water, for Milli Q UF water, and for tap water, pH was controlled titrating with 0.1M $H_2SO_4$.

| Buffer | Degree of bleaching (ΔL*) |
|---|---|
| Oxalate | 13.12 |
| Borate | 11.10 |
| De-ionized water | 10.38 |
| Acetate | 10.17 |
| Glycine | 10.05 |
| Milli Q UF water | 10.04 |
| Cold tap water | 9.26 |
| Maleic | 8.39 |
| Succinic | 7.34 |
| 3,3-Dimethylglutaric | 6.69 |
| B&R | 6.55 |
| Phosphate | 6.44 |
| Citrate/phosphate | 6.35 |
| Citrate | 3.15 |

The results obtained in Table 3 are in accordance with results obtained determining PPT radical stability ($T_{1/2}$) in various buffers at various pH following the general correlation: A high radical stability will give a high bleaching performance, and a low radical stability will give a low bleaching performance.

EXAMPLE 3

Bleaching Denim with Laccase and Phenothiazine-10-Propionic Acid at different pH values To illustrate pH's influence on the denim bleaching process, a pH profile was made in the following way:

0.01M oxalate buffer was adjusted to the appropriate pH in the range pH 4.0–pH 7.5 using oxalic acid or oxalate. 80 ml buffer was added to a 200 ml glass beaker together with a magnet bar (4 cm), and 8 circular pieces of denim (3.5 cm in diameter ~0.4 g), giving a denim:liquor ratio of 1:25. The glass beaker was incubated on a magnet stirrer (300 rpm) in a water bath at 50° C., and a pH electrode was dipped into the liquor in the middle of the beaker in order to monitor and control pH at the desired pH in the range 4.0–7.5 (i.e. the experiments were run under pH-stat conditions using a Radiometer pH-stat (PHM 82 or PHM 62 pH meter, TTT 80 Titrator, ABU 80 Autoburette) with automatic titration with 0.1M oxalic acid if and when pH increased above set-point).

Following equilibration at the desired pH, phenothiazine-10-propionic acid (PPT), 0.02M in 96% ethanol, was added to a final concentration of 83.3 μM ~2.1 μmole/g together with laccase from *Trametes villosa* (TvL) or *Myceliopthora thermophila* (MtL); TvL available from Novo Nordisk A/S and MtL produced as described in PCT/US95/06815, to a final concentration of 0.1 LACU/ml ~39 μg/g (TvL) and 54 μg/g (MtL).

After 10 and 20 minutes PPT was added corresponding to 83.3 μM–2.1 μmole/g (the total amount of PPT used is 250 μM ~6.3 μmole/g).

After 30 minutes the denim swatches were rinsed in tap-water and air dried on filter paper overnight, and the resulting degree of bleaching was determined as mentioned above in Example 1. The results are shown in Table 4.

TABLE 4

Bleaching obtained using 250 μM PPT (3 × 83.3 μM) – 6.3 μmole/g and 0.1 LACU/ml of TvL or MtL ~ 39 μg/g (TvL) and 54 μg/g (MtL), at pH 4.0–7.5 (pH-stat) in 30 minutes at 50° C. in 0.01M oxalate buffer. pH was continuously monitored and controlled at set-point pH titrating with 0.1M oxalic acid.

| | Degree of bleaching (ΔL*) | |
|---|---|---|
| pH | TvL | MtL |
| 4.0 | 0.98 | 1.27 |
| 4.5 | 3.16 | 2.62 |
| 5.0 | 2.77 | 4.70 |
| 5.5 | 4.36 | 6.88 |
| 6.0 | 5.65 | 5.45 |
| 6.5 | 6.79 | 4.94 |
| 7.0 | 6.36 | 1.76 |
| 7.5 | 2.82 | 1.00 |

It can be seen from Table 4 that when using the above described conditions the pH-optimum of the denim bleaching process for the *T. villosa* laccase is around pH 6.5 and the pH-optimum of the denim bleaching process for the *M. thermophila* laccase is around pH 5.5.

EXAMPLE 4

Bleaching Denim with Laccase and Phenothiazine-10-Propionic Acid at Different Temperatures To illustrate the influence of temperature on the denim bleaching process, a temperature profile was made in the following way:

0.01M oxalate buffer was adjusted to the appropriate pH using oxalic acid or oxalate. 80 ml buffer was added to a 200 ml glass beaker together with a magnet bar (4 cm), and 8 circular pieces of denim (3.5 cm in diameter ~0.4 g), giving a denim:liquor ratio of 1:25. The glass beaker was incubated on a magnet stirrer (300 rpm) in a water bath at the appropriate temperature in the range 30° C.–80° C., and a pH electrode was dipped into the liquor in the middle of the beaker in order to monitor and control pH at the desired pH (i.e. the experiments were run under pH-stat conditions using a Radiometer pH-stat (PHM 82 or PHM 62 pH meter, TTT 80 Titrator, ABU 80 Autoburette) with automatic titration with 0.1M oxalic acid if and when pH increased above set-point). Following equilibration at the desired pH, phenothiazine-10-propionic acid (PPT), 0.02M in 96% ethanol, was added to a final concentration of 83.3 μM ~2.1 μmole/g together with laccase from *Trametes villosa* (TvL) or *Myceliopthora thermophila* (MtL); TvL available from Novo Nordisk A/S and MtL produced as described in PCT/US95/06815, to a final concentration of 0.1 LACU/ml ~39 μg/g (TvL) and 54 μg/g (MtL).

After 10 and 20 minutes PPT was added corresponding to 83.3 μM ~2.1 μmole/g (the total amount of PPT is 6.3 μmole/g). After 30 minutes the denim swatches were rinsed in tap-water and air dried on filter paper overnight, and the resulting degree of bleaching was determined as mentioned above in Example 1. The results are shown in Table 5.

TABLE 5

Bleaching obtained using 250 μM PPT (3 × 83.3 μM) − 6.3 μmole/g and 0.1 LACU/ml of TvL or MtL ~ 39 μg/g (TvL) or 54 μg/g, at pH 6.5 and pH 5.5 respectively in 30 minutes in 0.01M oxalate buffer pH was continuously monitored and controlled at set-point pH titrating with 0.1M oxalic acid.

| | Degree of bleaching (ΔL*) | |
|---|---|---|
| Temperature °C. | TvL (pH 6.5) | MtL (pH 5.5) |
| 30 | 3.27 | 4.29 |
| 40 | 6.12 | 5.36 |
| 50 | 6.59 | 6.76 |
| 60 | 7.58 | 7.68 |
| 70 | 5.92 | 7.80 |
| 80 | 2.68 | 4.48 |

It can be seen from Table 5 that when using the above described conditions the temperature-optimum of the denim bleaching process for the *T. villosa* laccase is around 60° C. and the temperature-optimum of the denim bleaching process for the *M. thermophila* laccase is around 60°–70° C.

EXAMPLE 5

Enzyme Dosage Response in the Denim Bleaching Process

To illustrate the enzyme dosage response in the denim bleaching process, an enzyme dosage response profile was made in the following way:

0.01M oxalate buffer was adjusted to the appropriate pH using oxalic acid or oxalate. 80 ml buffer was added to a 200 ml glass beaker together with a magnet bar (4 cm), and 8 circular pieces of denim (3.5 cm in diameter ~0.4 g), giving a denim:liquor ratio of 1:25. The glass beaker was incubated on a magnet stirrer (300 rpm) in a water bath at the appropriate temperature, and a pH electrode was dipped into the liquor in the middle of the beaker in order to monitor and control pH at the desired pH (i.e. the experiments were run under pH-stat conditions using a Radiometer pH-stat (PHM 82 or PHM 62 pH meter, TTT 80 Titrator, ABU 80 Autoburette) with automatic titration with 0.1M oxalic acid if and when pH increased above set-point). Following equilibration at the desired pH, phenothiazine-10-propionic acid (PPT), 0.02M in 96% ethanol, was added to a final concentration of 83.3 μM~2.1 μmole/g together with laccase from *Trametes villosa* (TvL) or *Myceliopthora thermophila* (MtL); TvL available from Novo Nordisk A/S and MtL produced as described in PCT/US95/06815.

After 10 and 20 minutes PPT was added corresponding to 83.3 μM ~2.1 μmole/g, giving a total amount of PPT of 6.3 μmole/g. After 30 minutes the denim swatches were rinsed in tap-water and air dried on filter paper overnight, and the resulting degree of bleaching was determined as mentioned above in Example 1. The results are shown in Table 6.

TABLE 6

Bleaching obtained using 250 μM PPT (3 × 83.3 μM) ~ 6.3 μmole/g and different concentrations of TvL or MtL at pH 6.5 and pH 5.5, respectively, and at 60° C. and 70° C., respectively in 30 minutes in 0.01M oxalate buffer. pH was continuously monitored and controlled at set-point pH titrating with 0.1M oxalic acid.

| | Degree of bleaching (ΔL*) | |
|---|---|---|
| Enzyme Dosage | TvL (pH 6.5, 60° C.) | MtL (pH 5.5, 70° C.) |
| 0.01 LACU/ml ~ 3.9 μg/g (TvL) or 5.4 μg/g (MtL) | 3.70 | 5.19 |
| 0.05 LACU/ml ~ 19.5 μg/g (TvL) or 27 μg/g (MtL) | 8.93 | 8.30 |
| 0.1 LACU/ml ~ 39 μg/g (TvL) or 54 μg/g (MtL) | 10.97 | 9.43 |
| 0.5 LACU/ml ~ 195 μg/g (TvL) or 272 μg/g (MtL) | 14.32 | 8.91 |
| 1.0 LACU/ml ~ 390 μg/g (TvL) or 540 μg/g (MtL) | 12.98 | 6.96 |

It can be seen from Table 6 that when using the above described conditions both enzymes exhibit a typical enzyme dosage response profile, and that the enzyme dosage optimum of the denim bleaching process for the *T. villosa* laccase is around 0.5 LACU/ml ~195 μg/g and the enzyme dosage optimum of the denim bleaching process for the *M. thermophila* laccase is around 0.1 LACU/ml ~54 μg/g.

EXAMPLE 6

The Bleach Response as a Function of Time in the Denim Bleaching Process

To illustrate the bleach response as a function of time in the denim bleaching process, a time profile was made in the following way:

Two different buffers were used (B&R buffer and oxalate buffer). Each buffer was prepared at a concentration of 0.01M, and pH adjusted to the appropriate pH with NaOH or with the corresponding acid. 20 ml of the buffer in question was added to a 50 ml conical flask together with a magnet bar (4 cm), and 2 circular pieces of denim (3.5 cm in diameter ~0.4 g), giving a denim:liquor ratio of 1:25. The flasks were incubated on a magnet stirrer (300 rpm) in a water bath at 60° C. Following equilibration, phenothiazine-10-propionic acid (PPT) was added to a final concentration of 250 μM (0.02M in 96% ethanol) ~6.3 μmole/g together with laccase from *Trametes villosa* (TvL) to a final concentration of 0.1 LACU/ml ~39 μg/g, TvL available from Novo Nordisk A/S. Following bleaching the denim swatches were rinsed in tap water and air dried on filter paper overnight, and the resulting degree of bleaching was determined as mentioned above in Example 1.

6 identical flasks were made with each buffer system, and the degree of bleaching was determined after 5, 10, 15, 30, 45, and 60 minutes, respectively. The results are shown in Table 7.

TABLE 7

Bleaching obtained as a function of time for different buffer systems using 250 μM PPT ~ 6.3 μmole/g (added at the beginning of the experiment), 0.1 LACU/ml ~ 39 μg/g of TvL, at 60° C.

| Time (minutes) | Degree of bleaching (ΔL*) 0.01M B & R Buffer Initial pH: 6.0 Final pH: 6.2 | 0.01M Oxalate buffer Initial pH: 5.0 Final pH: 6.7–7.0 |
|---|---|---|
| (0) | (0) | (0) |
| 5 | 4.48 | 5.49 |
| 10 | 7.66 | 7.58 |
| 15 | 8.18 | 8.28 |
| 30 | 8.90 | 10.50 |
| 45 | 9.21 | 12.73 |
| 60 | 9.27 | 11.46 |

It can be seen from Table 7 that when using the above described conditions the bleaching process proceeds very fast for the first 10–15 minutes, and that the optimum bleaching time of the denim bleaching process for the *T. villosa* laccase is around 60 min. and around 45 min. when using B&R buffer and oxalate buffer, respectively.

EXAMPLE 7

Denim Bleaching in Larger Scale (300 ml) using $(NH_4)_2SO_4/NaHSO_4$ as Buffer Experiments were performed in larger scale (300 ml scale) in a launder-ometer. A pH profile in 20 mM $(NH_4)_2SO_4/NaHSO_4$ was made.

An Atlas LP2 launder-ometer was used. 300 ml 0.02M $(NH_4)_2SO_4/NaHSO_4$ was adjusted to the appropriate pH in the range pH 1.5–7.0. 300 ml buffer was added to a 1200 ml beaker together with 12 g denim (in one piece), giving a denim:liquor ratio of 1:25; additionally 30 LACU ~469 μg *Trametes villosa* laccase (TvL—available from Novo Nordisk A/S) and 0.020 g phenothiazine-10-propionic acid (PPT) were added resulting in a laccase concentration of 39 μg/g and a PPT concentration of 6.2 μmole/g.

The beakers were sealed and placed in the launder-ometer and processed for 55 minutes (15 minutes heating time 22° C.–60° C., 40 minutes holding time). After processing, samples of the processing liquor were diluted in methanol (10–25×) and analyzed for residual amount of PPT by HPLC.

The HPLC method was based on the following: Column: Supelcosil LC-18-DB, RP C-18, 3.6×250 mm, Eluent: 70% methanol, 30% 25 mM $PO_4$ buffer pH 6.5, Flow: 1.0 ml/min, Detection: UV/Vis diode array (monitoring at 238, 296, and 600 nm), Injection: 20 μl, Sample dilution: Methanol.

The results obtained are shown in Table 8.

TABLE 8

Bleaching obtained in launder-meter as a function of pH. Conditions: 300 ml 0.02 M $(NH_4)_2SO_4/NaHSO_4$buffer was added to a 1200 ml beaker together with 12 g denim (in one piece), 30 LACU [18] 469 μg TvL and 0.020 g PPT. The beakers were sealed and placed in the launder-meter and processed for 55 minutes (15 minutes heating time 22° C.–60° C., 40 minutes holding time).

| Initial pH | Final pH | ΔL* | Residual PPT (μM) |
|---|---|---|---|
| 1.56 | 1.57 | 2.66 | 58 1.5 μmole/g |
| 2.02 | 2.08 | 2.02 | 77 ~ 1.9 μmole/g |
| 2.48 | 2.67 | 2.82 | 48 ~ 1.2 μmole/g |
| 2.78 | 3.18 | 4.59 | 0 |
| 2.99 | 3.70 | 9.51 | 29 ~ 0.7 μmole/g |
| 3.15 | 4.34 | 13.10 | 0 |
| 3.28 | 5.22 | 15.33 | 0 |
| 3.41 | 5.75 | 14.93 | 0 |
| 3.61 | 6.0O | 18.36 | 0 |
| 3.81 | 6.15 | 13.81 | 0 |
| 4.03 | 6.28 | 17.31 | 23 ~ 0.6 μmole/g |
| 5.06 | 6.57 | 17.20 | 43 ~ 1.1 μmole/g |
| 5.97 | 7.24 | 9.04 | 200 ~ 5.0 μmole/g |
| 6.13 | 7.36 | 8.67 | 212 ~ 5.3 μmole/g |
| 6.70 | 7.89 | 4.31 | 273 ~ 6.9 μmole/g |
| 7.03 | 8.02 | 3.30 | 284 ~ 7.2 μmole/g |

It can be seen from Table 8 that a high degree of bleaching is achieved at an initial pH in the range of from 3.3 to 5.1, the highest degree of bleaching being at an initial pH value of about 3.6.

EXAMPLE 8

Denim Bleaching in Larger Scale (300 ml) using Acetate as Buffer

Experiments similar to the series using $(NH_4)_2SO_4/NaHSO_4$ (see Example 7) were made in acetate buffer. Conditions: An Atlas LP2 launder-ometer was used. 300 ml 10 mM acetate buffer pH 3.5–6.5 was added to a 1200 ml beaker together with 12 g denim (in one piece), giving a denim:liquor ratio of 1:25. Additionally 30 LACU ~469 μg *Trametes villosa* laccase (TvL) or 30 LACU ~652 μg *Myceliophthora thermophila* laccase (MtL)—TvL available from Novo Nordisk A/S and MtL produced as described in PCT/US95/06815—and 0.02 g phenothiazine-10-propionic acid (PPT) were added. The conditions were thus: 39 μg/g TvL or 54 μg/g MtL and 6.3 μmole/g PPT.

The beakers were sealed and placed in the launder-meter and processed for 40 minutes (10 minutes heating time 22° C.–60° C., 30 minutes holding time). After processing, samples of the processing liquor were diluted in methanol (10–25×) and analyzed for residual amount of PPT by HPLC.

The HPLC method was based on the following: Column: Supelcosil LC-18-DB, RP C-18, 3.6×250 mm, Eluent: 70% methanol, 30% 25 mM $PO_4$ buffer pH 6.5, Flow: 1.0 ml/min, Detection: UV/Vis diode array (monitoring at 238, 296, and 600 nm), Injection: 20 μl, Sample dilution: Methanol. The results obtained are shown in Tables 9–10 below.

TABLE 9

Bleaching obtained in launder-ometer as a function of pH. Conditions: 300 ml 0.01M acetate buffer was added to a 1200 ml beaker together with 12 g denim (in one piece), 30 LACU TvL (to 0.1 LACU/ml), and 0.020 g PPT (to 250 μM). The beakers were sealed and placed in the launder-ometer and processed for 40 minutes (10 minutes heating tiine 22° C.–60° C., 30 minutes holding time)

| Initial pH | Final pH | ΔL* | Residual PPT (μM) |
|---|---|---|---|
| 3.50 | 3.58 | 4.49 | 5 ~ 0.1 μmole/g |
| 4.00 | 4.07 | 7.21 | 16 0.4 μmole/g |
| 4.50 | 4.58 | 7.77 | 10 ~ 0.3 μmole/g |
| 5.00 | 5.10 | 11.29 | 0 |
| 5.50 | 5.91 | 13.51 | 16 ~ 0.4 μmole/g |
| 6.00 | 7.10 | 3.2 | 239 ~ 6.0 μmole/g |
| 6.50 | 7.61 | 2.47 | 242 ~ 6.1 μmole/g |
| 7.67[1)] | 8.23[1)] | 2.35[1)] | 258[1)] – 6.5 μmole/g |

[1)]:No buffer added, only tap water, PPT and laccase.

It can be seen from Table 9 that a very high degree of bleaching is achieved at an initial pH value of about 5.5.

TABLE 10

Bleaching obtained in launder-ometer as a function of pH. Conditions: 300 ml 10 mM acetate buffer was added to a 1200 ml beaker together with 12 g denim (in one piece), 30 LACU MtL (to 0.1 LACU/ml), and 0.020 g PPT (to 250 μM). The beakers were sealed and placed in the launder-ometer and processed for 40 minutes (10 minutes heating time 22° C.–60° C., 30 minutes holding time).

| Initial pH | Final pH | ΔL* | Residual PPT (μM) |
|---|---|---|---|
| 3.50 | 3.58 | 5.02 | 33 ~ 0.8 μmole/g |
| 4.00 | 4.06 | 7.87 | 12 ~ 0.3 μmole/g |
| 4.50 | 4.57 | 9.31 | 8 ~ 0.2 μmole/g |
| 5.00 | 5.12 | 12.07 | 12 ~ 0.3 μmole/g |
| 5.50 | 5.96 | 15.16 | 49 ~ 1.2 μmole/g |
| 6.00 | 7.43 | 8.65 | 204 ~ 5.1 μmole/g |
| 6.50 | 7.92 | 7.8 | 237 ~ 6.0 μmole/g |

It can be seen from Table 10 that a very high degree of bleaching is achieved at an initial pH value of about 5.5.

EXAMPLE 9

Dosage Response with Respect to Phenothiazine-10-Propionic Acid (PPT) in Larger Scale (300 ml)

To illustrate the dosage-response with respect to PPT, a series of experiments in launder-ometer scale was performed. An Atlas LP2 launder-ometer was used. 300 ml 20 mM $(NH_4)_2SO_4/NaHSO_4$ pH 5.4 was added to a 1200 ml beaker together with 12 g denim (in one piece), 30 LACU *Trametes villosa* (TvL)—available from Novo Nordisk A/S—(to 0.1 LACU/ml), and PPT in the range of from 50 μM to 500 μM. The conditions were thus: a denim:liquor ratio of 1:25; 39 μg/g denim TvL and 1.3 μmole/g denim—12.5 μmole/g denim PPT.

The beakers were sealed and placed in the launder-ometer and processed for 55 minutes (15 minutes heating time 22° C.–60° C., 40 minutes holding time). The results obtained are shown in Table 11.

TABLE 11

Dosage-response with respect to PPT in launder-ometer scale. Conditions: 300 ml 0.02 M $(NH_4)_2SO_4/NaHSO_4$ pH 5.4 was added to a 1200 ml beaker together with 12 g denim (in one piece), 30 LACU TvL (to 0.1 LACU/ml), and PPT in the range 50 μM–500 μM. The beakers were sealed and placed in the launder-ometer and processed for 55 minutes (15 minutes heating time 22° C.–60° C., 40 minutes holding time)

| PPT (μM) | ΔL* | Final pH |
|---|---|---|
| 50 ~ 1.3 μmole/g | 4.41 | 7.08 |
| 100 ~ 2.6 μmole/ | 7.06 | 6.88 |
| 250 ~ 6.3 μmole/g | 14.63 | 6.88 |
| 500 ~ 12.5 μmole/g | 19.21 | 6.67 |

It can be seen from Table 11 that at the above given conditions the degree of bleaching is increased with the increased concentration of PPT.

EXAMPLE 10

Bleaching Denim with Peroxidase and Phenothiazine-10-Propionic Acid (PPT) using Different Buffers To illustrate the bleaching process using peroxidase comparison of 2 high-performance buffers was made using PPT as an enhancing agent.

Method:

Each buffer was prepared at a concentration of 0.01M, and pH adjusted to pH 6.5 with NaOH or with the corresponding acid. 80 ml of the buffer in question was added to a 200 ml glass beaker together with a magnet bar (4 cm), and 8 circular pieces of denim (3.5 cm in diameter ~0.4 g), giving a denim:liquor ratio of 1:25. The glass beaker was incubated on a magnet stirrer (300 rpm) in a water bath at 50° C., and a pH electrode was dipped into the liquor in the middle of the beaker in order to monitor and control pH at pH 6.5 (i.e. the experiments were run under pH-stat conditions using a Radiometer pH-stat (PHM 82 or PHM 62 pH meter, TTT 80 Titrator, ABU 80 Autoburette) with automatic titration with the corresponding acid (0.1M) if and when pH increased above pH 6.5). Following equilibration at pH 6.5, PPT (0.02M in 96% ethanol) was added to a final concentration of 250 μM ~6.3 μmole/g together with peroxidase from *Coprinus cinereus* (CiP, available from Novo Nordisk A/S) to a final concentration of 1 PODU/ml ~5 μg/g. Reaction was started adding 0.1 ml $H_2O_2$ (0.1M) corresponding to a final concentration of 0.125 mM $H_2O_2$. The concentration of $H_2O$ was monitored using peroxide sticks (Merckoquant Peroxid-Test, Merck. art. 10011). When the sticks indicated that the concentration of $H_2O_2$ was below 2 mg/l (0.059 mM), another 0.1 ml of $H_2O_2$ was added. However, the PPT radical seemed to interfere with the measurement in that the PPT radical itself (without the presence of $H_2O_2$) was able to colourize the sticks. But, for this purpose, only an indication of low concentration of $H_2O_2$ and low concentration of PPT radical was of interest, since no addition of hydrogen peroxide was needed even if the concentration was zero, as long as PPT radical was present. Only if the concentration of both $H_2O_2$ and PPT radical was low/zero, more $H_2O_2$ should be added. After 30 minutes the denim swatches were rinsed in tap water and air dried on filter paper overnight, and the resulting degree of bleaching was determined as mentioned above in Example 1. The are shown in Table 12 below.

TABLE 12

Comparison of bleach performance in acetate and oxalate buffer using 250 μM PPT and 1 PODU/ml peroxidase (CiP) at pH 6.5 and 50° C. $H_2O_2$ was added semi-continuously over time adding aliquots of 0.1 ml of a stock solution of 0.1M $H_2O_2$.

| Acetate | | | Oxalate | | |
|---|---|---|---|---|---|
| Time (minutes) | Conc. $H_2O$, (mg/l) | $H_2O_2$ added (ml) | Time (minutes) | Conc. $H_2O$, (mg/l) | $H_2O_2$ added (ml) |
| 0 | — | 0.1 | 0 | — | 0.1 |
| 1 | 5 | — | 1 | 5 | — |
| 2.5 | 2 | — | 3 | 2 | 0.1 |
| 3 | — | 0.1 | 5 | 2 | — |
| 6 | 2 | 0.1 | 5.5 | — | 0.1 |
| 8 | 2 | 0.1 | 8 | 2 | 0.1 |
| 10.5 | 2 | — | 11 | 2 | 0.1 |
| 11 | — | 0.1 | 13 | 2 | 0.1 |
| 14 | 2 | — | 15 | 2 | 0.1 |
| 14.5 | — | 0.1 | 17 | 3.5 | — |
| 17 | 2 | 0.1 | 20 | 2 | 0.1 |
| 21 | 3.5 | — | 25 | 2 | 0.1 |
| 23 | 2 | 0.1 | 28 | 5 | — |
| 26 | 5 | — | 30 | 3 | — |
| 30 | 2.5 | — | — | — | — |
| Total: | — | 0.8 | Total: | — | 0.9 |
| ΔL*: | — | 14.5 | ΔL*: | — | 16.5 |

It can be seen from Table 12 that a high degree of bleaching can be achieved when using peroxidase, PPT and acetate or oxalate as buffers.

EXAMPLE 11

Large Scale Trials (40 Liters)

Large-scale trials (40 liters) with bleaching of denim using laccase and phenothiazine-10-propionic acid (PPT) have been performed giving the results shown below:

105.32 g $(NH_4)_2SO_4$, 25.48 g $NaHSO_4$x1 $H_2O$, 2.7 g PPT and 1.6 kg stonewashed denim was loaded into a wascator, giving a denim:liquor ratio of 1:25 and 6.3 μmole/g denim of PPT.

40 liters of cold tap water was added together with 4000 LACU ~62500 μg *Trametes villosa* laccase (TvL—available from Novo Nordisk A/S), giving 0.1 LACU/ml or 39 μg/g denim of TvL; temperature was raised to and maintained at 60° C. for a total processing time of 60 minutes, followed by a rinsing/inactivation step with $Na_2CO_3$ (1 g/l) at 80° C. for 15 minutes, followed by a rinse with tap water. After bleaching, the denim was dried in a conventional tumble dryer.

The process resulted in a bleach level of ΔL*=16–17.

EXAMPLE 12

Absorbed Organic Halogens (AOX)

As a result of the chlorine-free bleaching process, AOX was expected to be significantly lower using the enzymatic approach compared to the conventional hypochlorite based process. In Table 13 below, AOX data are shown for various bleach levels using the enzymatic approach and the conventional approach.

TABLE 13

Comparison of the resulting AOX-values of the processing liquor following denim bleaching using conventional hypochlorite process, and the enzymatic process. All experiments were run in wascator scale (20–40 liters). The AOX values have been determined by VKI (the Danish Water Quality Institute).

| Bleach Method | Bleach Level ΔL* | AOX-values ppm |
|---|---|---|
| Hypochlorite | 11.1 | 14 |
| Hypochlorite | 18.7 | 21 |
| Peroxidase/PPT | 5.6 | <0.0025[1)] |
| Laccase/PPT | 17 | n.d.[2)] |

[1)]Below detection limit
[2)]Not determined

EXAMPLE 13

Strength Loss

The enzyme/enhancing agent bleaching process of the present invention results in a very specific attack on indigo and does not result in a damage of the cotton. This is illustrated in the strength loss of the processed denim. Using the enzyme/enhancing agent bleaching process the strength loss is much lower than by using the conventional hypochlorite process, which is illustrated in Table 14 below.

Stone washed denim was bleached to the same level using hypochlorite and using laccase/PPT, and the strength loss (tear strength of processed denim compared to tear strength of non-processed denim) determined. The results are shown in Table 14 below.

TABLE 14

Comparison of tensile strength loss using hypochlorite and using Laccase/PPT for bleachlng of denim.

| | ΔL* | % tensile strength loss (warp) |
|---|---|---|
| NaOCl | 17.99 | 15.8% |
| Laccase/PPT | 18.27 | 1.7% |

EXAMPLE 14

Large-Scale Trials

Large-scale trials with bleaching of denim using laccase and phenothiazine-10-propionic acid (PPT) have been performed in a fulling machine (stainless steel drum of 1 m diameter and 0.4 m in dept operated at approx. 14 rpm) giving the results shown below:

The denim (75×100 cm) was sewn into "legs" (denim cylinders) weighing approximately 350–375 g each (not stone washed). 4 stone washed denim "legs" weighing 1458 g total, 40.8 g $Na_2$-oxalate, 12.0 g oxalic acid×2 $H_2O$ and 1.82 g PPT was loaded into the fulling machine, and 20 liters of hot (55° C.) tap water was added resulting in a pH of 5.5 increasing to 7.2 in 5 minutes. The liquor was heated to 60° C. and pH was adjusted to pH 5.6 with 2 ml of 72% $H_2SO_4$, and 1824 LACU=28500 μg TvL (*Trametes villosa* laccase, available from Novo Nordisk A/S) was added.

The conditions used were: 0.02M oxalate buffer, pH 5.6–6.0, denim:liquor ratio=1:14, 336 μM PPT=4.6 μmole PPT/g denim, 0.09 LACU/ml=19.5 μg enzyme protein/g denim. The bleaching was stopped after 30 minutes, and the denim rinsed with 2×20 liters of hot (55° C.) tap water for 1–2 minutes. Following bleaching, the denim was dried in a conventional tumble drier.

The process resulted in a bleach level of ΔL*: 17–18.

EXAMPLE 15

Large-Scale Trials

Denim (75×100 cm) was sewn into "legs" (denim cylinders) weighing approximately 350–375 g each (not stone washed). 4 stone washed denim "legs" weighing 1480 g total, 24.2 g $Na_2$-oxalate, 12.5 g oxalic acid×2 $H_2O$, and 1.75 g PPT was loaded into the fulling machine, and 14 liters of hot (55° C.) tap water was added and heated to 60° C. resulting in a pH of 4.8. pH was adjusted to pH 5.7 with 1.5 ml 50% NaOH. 1755 LACU=27422 μg TvL was added (TvL=*Trametes villosa* laccase, available from Novo Nordisk A/S).

The conditions used were: 0.02 M oxalate buffer, pH 5.7–5.9, denim:liquor ratio=1:10, 461 μM PPT=4.4 μmole PPT/g denim, 0.13 LACU/ml=18.5 μg enzyme protein/g denim. The bleaching was stopped after 30 minutes, and the denim rinsed with 2×40 liters of hot (55° C.) tap water for 1–2 minutes. After bleaching, the denim was dried in a conventional tumble drier. The process resulted in a bleach level of ΔL*: 14–15.

EXAMPLE 16

Industrial Scale Trials (450 liters)

Industrial scale trials (450 liters) with bleaching of denim using laccase and phenothiazine-10-propionic acid (PPT) have been carried out in a front loaded wash extractor (type: "Cherry Tree"), using 50 kg of denim (60 pair of jeans) and 450 liters of water, giving a denim:liquor (w/w) ratio of 1:9. Conditions and dosages were as follows:

Trial 1:

450 g sodium phosphate 125 g di-sodium phosphate 125 g PPT ~9.2 μg/g denim 90.000 LACU (=1406 mg) *Trametes villosa* laccase, available from Novo Nordisk A/S ~29.2 μg/g denim 30 minutes, pH=6.2, 60° C.

Trial 2:

1000 g di-sodium oxalate 175 g oxalic acid 125 g PPT ~9.2 μg/g denim 90.000 LACU (=1406 mg) *Trametes villosa* laccase 29.2 μg/g denim 30 minutes, pH=5.5, 60° C.

Following bleaching, the denim was tumble dried. The process resulted in bleach levels of ΔL*=16 (trial 1) and ΔL*=21 (trial 2).

We claim:

1. A process for providing a bleached look in the colour density of the surface of dyed fabric, the process comprising contacting, in an aqueous medium, a dyed fabric with a phenol oxidizing enzyme system and an enhancing agent of the following formula:

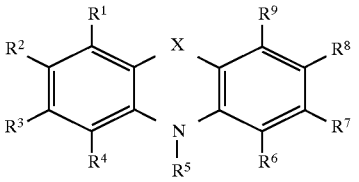

in which X represents (—O—) or (—S—), and the substituent groups $R^1$–$R^9$, which are identical or different, independently represent any of the following radicals: hydrogen, halogen, hydroxy, formyl, carboxy and esters and salts thereof, carbamoyl, sulfo and esters and salts thereof, sulfamoyl, nitro, amino, phenyl, $C_1$–$C_{14}$-alkyl, $C_1$–$C_5$-alkoxy, carbonyl-$C_1$–$C_5$-alkyl, aryl-$C_1$–$C_5$-alkyl; in which said carbamoyl, sulfamoyl and amino are unsubstituted or substituted once or twice with a substituent group $R^{10}$; in which said phenyl is unsubstituted or substituted with one or more substituent groups $R^{10}$; in which said $C_1$–$C_{14}$-alkyl, $C_1$–$C_5$-alkoxy, carbonyl-$C_1$–$C_5$-alkyl, and aryl-$C_1$–$C_5$-alkyl groups are saturated or unsaturated, branched or unbranched, and are unsubstituted or substituted with one or more substituent groups $R^{10}$;

which substituent group $R^{10}$ represents any of the following radicals: halogen, hydroxy, formyl, carboxy and esters and salts thereof, carbamoyl, sulfo and esters and salts thereof, sulfamoyl, nitro, amino, phenyl, aminoalkyl, piperidino, piperazinyl, pyrrolidino, $C_1$–$C_5$-alkyl, $C_1$–$C_5$-alkoxy; in which said carbamoyl, sulfamoyl and amino is unsubstituted or substituted once or twice with hydroxy, $C_1$–$C_5$-alkyl, $C_1$–$C_5$-alkoxy; and in which said phenyl is substituted with one or more of the following radicals: halogen, hydroxy, amino, formyl, carboxy and esters and salts thereof, carbamoyl, sulfo and esters and salts thereof, and sulfamoyl; and which said $C_1$–$C_5$-alkyl, and $C_1$–$C_5$-alkoxy are saturated or unsaturated, branched or unbranched, and is substituted once or twice with any of the following radicals: halogen, hydroxy, amino, formyl, carboxy and esters and salts thereof, carbamoyl, sulfo and esters and salts thereof, and sulfamoyl;

or in which two of the substituent groups in $R^1$–$R^9$ form a group —B—, in which B represents any of the following groups: (—$CHR^{10}$—N=N—), $(—CH=CH—)_n$, (—CH=N—), or (—N=$CR^{10}$—$NR^{11}$—), in which groups n represents an integer of from 1 to 3, $R^{10}$ is a substituent group as defined above and $R^{11}$ is defined as $R^{10}$.

2. The process according to claim 1, wherein the fabric is dyed with a vat dye.

3. The process according to claim 1, wherein the fabric is dyed with a vat dye selected from the group consisting of indigo and thioindigo.

4. The process according to claim 1, wherein the fabric is a cellulosic fabric or a mixture of cellulosic fibres or a mixture of cellulosic fibres and synthetic fibres.

5. The process according to claim 1, wherein the fabric is denim.

6. The process according to claim 1, wherein the fabric is denim dyed with indigo or thioindigo.

7. The process according to claim 1, wherein the phenol oxidizing enzyme system is a peroxidase and a hydrogen peroxide source.

8. The process according to claim 7, wherein the peroxidase is horseradish peroxidase, soybean peroxidase or a peroxidase enzyme derived from Coprinus, Bacillus, or Myxococcus.

9. The process according to claim 1, wherein the phenol oxidizing enzyme system is a peroxidase derived from *C. cinereus* or *C. macrorhizus.*

10. The process according to claim 1, wherein the phenol oxidizing enzyme system is a peroxidase derived from *B. pumilus.*

11. The process according to claim 1, wherein the phenol oxidizing enzyme system is a peroxidase derived from *M. virescens.*

12. The method according to claim 7, wherein the hydrogen peroxide source is hydrogen peroxide, a hydrogen peroxide precursor, a hydrogen peroxide generating enzyme system, or a peroxycarboxylic acid or a salt thereof.

13. The method according to claim 7, wherein the hydrogen peroxide source is a hydrogen peroxide precursor selected from the group consisting of perborate and percarbonate.

14. The method according to claim 7, wherein the hydrogen peroxide source is an oxidase or its substrate.

15. The method according to claim 7, wherein the aqueous medium contains $H_2O_2$ or a precursor for $H_2O_2$ in a concentration corresponding to 0.001–25 mM $H_2O_2$.

16. The process according to claim 7, in which the phenol oxidizing enzyme system is a laccase or a laccase related enzyme together with oxygen.

17. The process according to claim 16, wherein the laccase is derived from Trametes, Myceliophthora, or Coprinus.

18. The process according to claim 1, wherein the laccase is derived from *Trametes villosa, Myceliophthora thermophila,* or *Coprinus cinereus.*

19. The process according to claim 5, wherein the concentration of the phenol oxidizing enzyme corresponds to 0.001–10000 $\mu$g of enzyme protein per g of denim.

20. The process according to claim 1, wherein the enhancing agent is selected from the group consisting of phenoxazine-10-propionic acid, phenoxazine-10-hydroxyethyl, phenothiazine-10-ethyl-4-carboxy, phenothiazine-10-propionic acid, promazine hydrochloride and phenothiazine-10-ethylalcohol.

21. The process according to claim 5, wherein the enhancing agent in the aqueous medium is present in a concentration of from 0.005 to 1000 $\mu$mole/g denim.

22. The process according to claim 1 resulting in reduced strength loss of fabric compared to conventional bleaching processes.

* * * * *